United States Patent [19]

Mumford

[11] 4,117,945

[45] Oct. 3, 1978

[54] CHILD-RESISTANT SAFETY CLOSURE

[75] Inventor: George V. Mumford, Toledo, Ohio

[73] Assignee: Owens-Illinois, Inc., Toledo, Ohio

[21] Appl. No.: 811,411

[22] Filed: Jun. 29, 1977

[51] Int. Cl.[2] ..... B65D 55/02; B65D 85/56; A61J 1/00

[52] U.S. Cl. ..... 215/216

[58] Field of Search ..... 215/216, 217, 218

[56] References Cited

U.S. PATENT DOCUMENTS

| | | | |
|---|---|---|---|
| 3,941,268 | 3/1976 | Owens et al. | 215/216 |
| 3,949,893 | 4/1976 | Uhlig | 215/216 |
| 3,989,152 | 11/1976 | Julian | 215/217 |
| 3,993,208 | 11/1976 | Ostrowsky | 215/216 |

*Primary Examiner*—George T. Hall

*Attorney, Agent, or Firm*—Richard B. Dence; Myron E. Click; David H. Wilson

[57] ABSTRACT

A child-resistant, safety closure for a container having a dispensing end including a threaded neck portion. The closure features an inner sidewall threadably attachable on the container neck portion and an outer sidewall having a flexible and resiliently distensible distal end portion with at least one interlocking member adapted to automatically interlockingly engage the dispensing end of the container when the closure is in either a fully closed or in at least one additional, partially removed position on the container neck portion. Removal of the closure requires manual compression of the outer sidewall at locations straddling the interlocking members, coupled with concurrent retrogressive movement of the closure. Ordinarily, such manual manipulation must be repeated at each interlocking position of the closure. Moreover, as a further safety factor, the interlocking members are inaccessibly and unobservably secluded within the interior confines of the closure when it is interlocked on the container.

Alternative embodiments of the invention feature the provision of means for providing a frictional, fluid-tight seal which serves to prevent leakage of the container's contents even though the closure is partially removed from its fully closed position, or which is operative to prevent leakage of the container's contents at and between both the fully closed and the succeeding partially removed interlocking locations of the closure on the container end.

27 Claims, 18 Drawing Figures

CHILD-RESISTANT SAFETY CLOSURE

BACKGROUND OF THE INVENTION

1. Field of the Invention

The present invention pertains to a child-resistant, safety closure for packaging ingredients such as household chemicals, medicaments, or other ingredients, which may be dangerous and harmful to children and other persons of insufficient mental capacity to appropriately comprehend the threat of serious injury or death posed by contact with, or improper use of, such ingredients. Thus, the closure is of the type which is constructed in such manner that its removal from the container requires that a knowledgeable and purposeful thought process be employed in conjunction with a manual dexterity which is beyond the capabilities of an immature child or a person of similar mental faculties.

2. Description of the Prior Art

Heretofore, numerous versions of safety closures have been designed for the purpose of preventing children and other unknowledgeable persons from gaining access to dangerous household chemicals, medicaments and drugs such as are conventionally packaged in containers for consumer use. Among such types of safety closures are those which are of the nonreusable type associated with unit dose or single use containers. However, many types of dangerous and harmful household chemicals, medicines, and the like, characteristically are of the type which are packaged for frequent, repeated usage, or dispensation, and thereby require the employment of a safety closure which is susceptible to being frequently removed and reattached on the container, while at the same time retaining the features of being a child-resistant, safety closure. Among the latter types of safety closures which have attained substantial commercial acceptance are those which are frequently referred to as "squeeze-and-turn" types of safety closures. Various prior art types of patented squeeze-and-turn safety closures are described in, among others, U.S. Pat. Nos. 3,984,021 and 3,376,991 which require major modifications in the shape of the container neck portion in order to accommodate adequate deformation of the safety closure in response to manual compression, or squeezing to disengage it from the container.

Another version of a squeeze-and-turn safety closure designed for use with a container having a more conventionally styled circular neck portion is described in U.S. Pat. No. 3,941,268. While the last-mentioned patent provides a safety closure construction which features such advantages as being utilizable with a container having a more conventional type of neck portion and which also provides a highly desirable secondary interlock between the safety closure and the container neck portion, the safety closure is a single sidewalled closure and, as a result, offers only limited versatility with respect to the style and design of the container with which it can be utilized. In other words, by virtue of the single sidewall construction, both the internal threaded portion of the closure and the interlocking members, of necessity, are integral components of the same sidewall. Thus, in order to provide adequate flexibility to deform, or distend, the sidewall sufficiently to disengage it from the neck portion of the container, the sidewall must extend substantially beyond the threaded portion, which is rigidly engaged with the container neck portion. Also, to provide sufficient space to accommodate such deformation, the sidewall is necessarily flared outwardly from the neck of the container. Thus, the style and design of the closure is quite restricted.

An additional problem existent with most of the known safety closures resides in the common use of a sealing liner positioned on the underside surface of the closure, and which abuts and seals against the annular rim on the container neck portion to prevent leakage of the container's contents. Customarily, most of the commonly employed sealing liners are fabricated in the form of thin discs of resilient plastic material which is sufficiently pliant to accommodate small imperfections in the rim surface of the container neck portion and provide a fluid-tight seal therewith. However, it is not uncommon for such plastic sealing materials to undergo plastic flow when compressed repetitively, or for prolonged periods of time, against the annular rim on the neck portion of the container. As a result, during the course of repeated removal and replacement of the closure in order to reach a fully closed position, the closure frequently must be further and further tightened to compensate for such liner deformation. As a result, the fully closed and sealed position of the closure gradually changes and causes a corresponding change in the rotational position of the closure relative to the container neck portion. However, since the relative rotational orientation of the interlocking members provided on the container and the safety closure remains unchanged, the fully closed and sealed position of the closure no longer orientationally corresponds to the original interlocking, fully closed position, and leakage of the container's contents is apt to occur in the event that the safety closure is loosened or otherwise returned to its original fully closed and interlocked location on the neck portion of the container. Consequently, although the safety closure may be positioned in its original fully closed position in interlocked engagement with the container, the sealing liner may have been rendered ineffective to prevent leakage of the container's contents. Thus, a child while handling the container may come into harmful or injurious contact with the contents leaking from the container.

Also, many of the patented prior art types of squeeze-and-turn safety closures employ readily observable, exposed tabs and complementary detents on the closure and container for purposes of preventing closure removal. Indicative of patents employing such exposed tabs are previously mentioned U.S. Pat. No. 3,984,021 and such other representative patents as U.S. Pat. Nos. 3,770,153; 3,826,395; 3,830,391 and 3,841,514. Among other possibilities, the repeated flexing or stressing of such tabs renders them susceptible to being weakened in consequence of stress damage, and thus apt to failure when subjected to even minimal force such as might be exerted by a child attempting to remove the closure. No less importantly, the exposed and observable presence of such tabs makes them more susceptible to being disengaged from the container by an inquisitive child.

SUMMARY OF THE INVENTION

In accordance with the present invention, a child-resistant, safety closure is provided for assemblement with a container in such manner as to preclude a child, or a person of comparable mental capability, from either removing the closure or becoming exposed to the container's contents. The safety closure features the advantages of having a double sidewalled construction in which an inner sidewall is threadably engageable with the threaded neck portion of the container and in which an outer sidewall is resiliently deformable independently of the inner sidewall and also is provided on its interior surface with interlocking members designed to interlockingly engage the dispensing end of the container, both when the safety closure is in a fully closed and sealed position and when the safety closure is positioned in at least one partially removed location on the threaded neck portion of the container. The resiliently deformable, or distensible, construction of the outer sidewall is such that manual compression of the outer sidewall, at locations straddling the interlocking members, coupled with concurrent retrogressive rotation of the closure will permit disengagement of the interlocking members and permit partial removal of the closure to the next interlocking location where such manual compression and retrogressive movement must ordinarily be repeated to further remove the closure.

Of added significance, the interlocking members are structured and designed in such manner that they are arranged to interlock within the interior confines of the closure and thus be secluded and rendered inaccessible and unobservable when the closure is assembled on the container.

In combination with the foregoing features, the safety closure of the present invention is suitably designed to also be adapted to provide a fluid-tight seal which is capable of maintaining fluid-tight sealing contact with the container neck portion even though a conventionally provided sealing liner becomes ineffective to prevent leakage of the container's contents, or even when the safety closure is partially removed through retrogressive threaded rotation from its fully closed position to the next succeeding interlocking location.

Keeping the foregoing features in mind, it is a principal objective of the present invention to provide an improved child-resistant, safety closure which in order to be removed from the container necessitates knowledgeable intent beyond the capabilities of an immature child or person of like mentality.

Another objective of the present invention is the provision of a child-resistant, safety closure having interlocking means which defy its removal from a container by a child and which is characterized by having the interlocking means disposed in a location which is both inaccessible and unobservable when the closure is assembled on a container.

Another objective of the present invention is to provide a safety closure possessing the last-mentioned characteristics and which also is designed to incorporate a double sidewalled construction affording substantial design versatility to thereby render the safety closure more readily adaptable to a variety of containers having widely differing neck dimensions and proportional styling characteristics.

An additional objective of the present invention is the provision of a child-resistant, safety closure which is structured in such manner that it will interlockingly engage the dispensing end of the container both in its fully closed and sealed position on the container neck portion and also interlockingly engage the dispensing end of the container in another partially removed location on the container neck portion, to thereby provide additional protection and precaution against accidental removal by a child or comparable immature person.

A further objective of the present invention is the provision of a safety closure which in addition to possessing the characteristics of the last-mentioned objective is also capable of maintaining fluid-tight sealed relationship with the dispensing end of the container, both when located in either its fully closed position or when located in a partially removed secondary interlocking location on the container neck portion.

The specific nature of the present invention, as well as other objects and advantages thereof, will become readily apparent to those ordinarily skilled in the art from the following detailed description taken in conjunction with the annexed drawings wherein, by way of example only, certain preferred embodiments of the present invention are illustrated.

DETAILED DESCRIPTION OF THE PREFERRED EMBODIMENTS OF THE INVENTION

Figure 1:
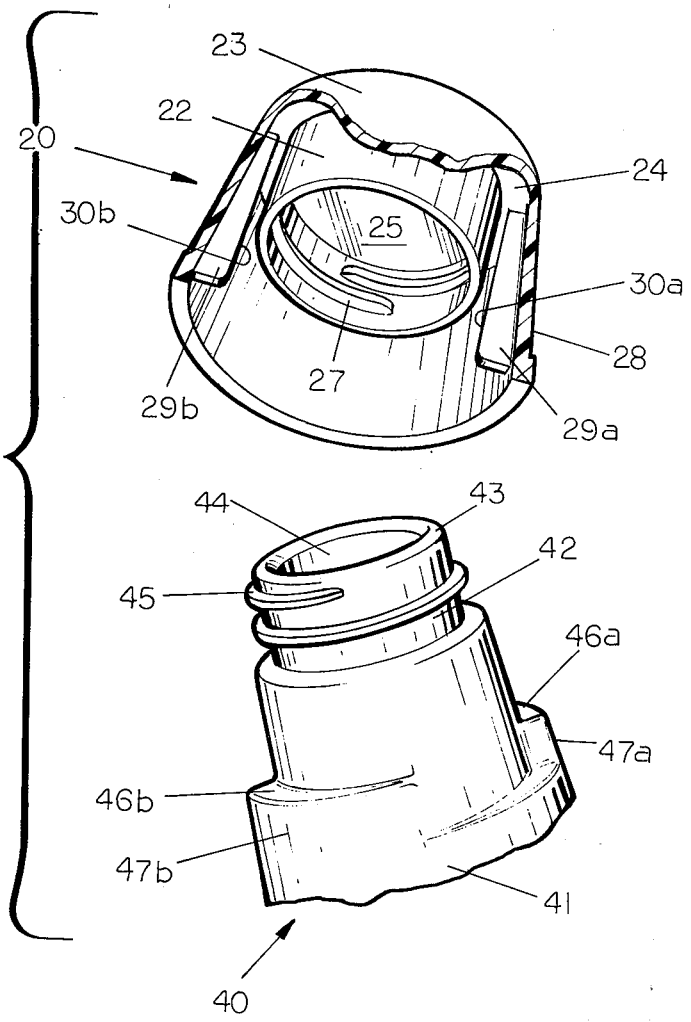
FIG. 1 is a perspective, exploded, elevational view of the dispensing end of a container and a child-resistant safety closure embodying one preferred version of the present invention.

In accordance with one preferred embodiment of the present invention exemplified in FIG. 1, a safety closure 20 is perspectively illustrated in disassembled overlying relationship with a container generally designated as 40 and only the dispensing end 41 of which is shown. The closure 20 is designed to be threadably assembled on the dispensing end 41 and threadably advanced to a fully closed position depicted in FIG. 2. When thus assembled, the safety closure 20 is designed to interlock with the dispensing end 41 of the container 40 and resist retrogressive threaded movements necessary for normal threaded removal of the closure from the container.

As illustrated, the safety closure 20, which is preferably fabricated from a resilient plastic, such as polyvinyl chloride, polypropylene, or similar resilient or pliant material, defines a generally cup-shaped overall configuration and includes a closed endwall 21 carrying depending, integral, coaxially aligned and mutually interspaced, inner and outer annular sidewalls 22 and 23, respectively. Adhesively adhered or otherwise affixed to the underside surface 24 of the closed endwall 21, there is preferably a sealing liner 25 which, as will subsequently be described in greater detail, is adapted to firmly seal against the dispensing end 41 of the container 40 in fluid-tight sealed relationship when the closure 20 is assembled on the container in the fully closed position shown in FIG. 2. If desired, however, a linerless closure may also be employed if the closure endwall is sufficiently pliant to provide a fluid-tight seal with the dispensing end of the container.

Provision for threadable engagement of the closure 20 on the dispensing end 41 of the container is afforded by the inner sidewall 22 which defines a threaded section on its interiorly facing surface having a continuous female thread 27. The outer sidewall 23 defines a generally frusto-conical configuration and is of flexible and resiliently deformable construction. Also, as illustrated, the outer sidewall 23 extends axially beyond the depending end of the inner sidewall 22 to define a distal end portion 28 of generally circular cross-sectional configuration, and which is adapted to cooperatively interlock with the dispensing end 41 of the container in at least two separate threadably assembled positions to be subsequently described.

The means for interlocking the distal end portion 28 of the outer sidewall 23 with the dispensing end 41 of the container 40 is provided in the form of a pair of diametrically opposite and axially extending locking ribs **29*a* and 29*b* integrally formed on the interiorly facing surface of the outer sidewall and which project radially inward into the interspace between the inner and outer sidewalls 22 and 23 to define narrow interiorly facing surfaces 30*a* and 30*b*, respectively, paralleling the central longitudinal axis of the closure. Also, as shown, the locking ribs 29*a* and 29*b* extend essentially the entire interior length of the outer sidewall and each has one longitudinal end adjoining the underside surface of the closed endwall 21 and an opposite end terminating at a location proximately recessed within the interior confines of the distal end portion 28 of the outer sidewall 23. Thus, the locking ribs 29*a* and 29*b*** are secluded within the closure, and when the closure is assembled on the dispensing end of the container, the locking ribs are inaccessible and unobservable.

With regard to the container 40, the dispensing end 41 thereof includes an exteriorly threaded neck portion 42 terminating in an annular rim 43 which, in turn, defines a dispensing opening at 44 communicating with the interior confines of the container. The threaded neck portion 42 may be conventionally formed with a continuous integral male thread 45 designed for complementary threaded engagement with the female thread 27 on the inner sidewall 22 of the safety closure 20 and located axially between the annular rim 43 and interlocking means integrally formed on the exterior surface of the container dispensing end 41.

In more particular respects, the interlocking means includes a pair of diametrically opposite, peripherally extending shoulder segments **46*a* and 46*b*, each of which respectively defines an eccentric peripherally tapered, or inclined, edge surface which functions as a camming surface 47*a*, 47*b*. As illustrated, each of the camming surfaces is inclined, or peripherally enlarges, in the direction of the path of threaded attachment, or advancement, of the closure 20 onto the dispensing end 41 of the container 40, and, as best observed in FIGS. 3–5, terminates abruptly in a radial ledge, such as 48*a* and 48*b*, which forms an abutment projecting radially from the dispensing end of the container to the inclined end of each of the camming surfaces 47*a* and 47*b*. The radial ledges 48***a* and 48*b* are strategically located at diametrically opposite peripheral locations, i.e. 180° apart, on the dispensing end 41 and are orientationally arranged to respectively abut against one each of the closure locking ribs 29*a* and 29*b* when the closure is threadably advanced to a fully closed position, such as is indicated in FIGS. 2 and 3, and in which position the sealing liner 25 is adapted to tightly seal the dispensing opening 44 by bearing against and forming a fluid-tight seal with the annular rim 43.

Figure 2:
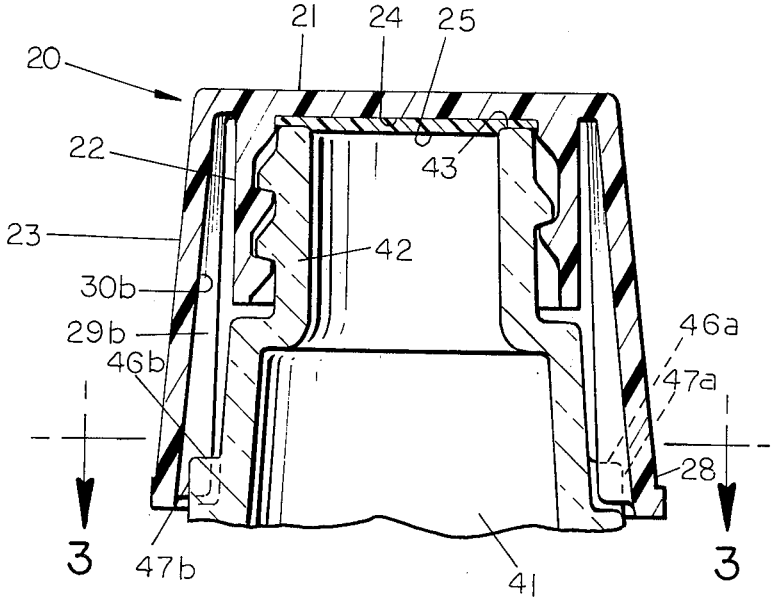
FIG. 2 is an elevational view in central section of the safety closure and the dispensing end of the container depicted in FIG. 1, but showing the safety closure in fully closed and interlocked child-resistant engagement with the dispensing end of the container.

By virtue of the particular construction described above, during the course of threaded attachment, or advancement, of the safety closure 20 on the container dispensing end 41, the locking ribs 29*a* and 29*b* will, prior to reaching the fully closed position, shown in FIG. 2, individually contact the inclined camming surfaces 47*a* and 47*b*. Thereafter, further threaded advancement of the closure will cause the locking ribs 29*a* and 29*b* to flex radially outward as they ride on the gradually inclined camming surfaces 47*a* and 47*b* and thereby deform, or distend, the resiliently flexible distal end portion 28 of the closure outer sidewall 23 sufficiently to accommodate continued manual threaded advancement of the closure to the fully closed position shown in FIG. 2 in which, as previously described, the sealing liner 25 on the underside surface 24 of the closed endwall 21 of the closure 20 is pressed into fluid-tight sealing contact with the annular rim 43. As illustrated, the radial ledges 48*a* and 48*b* are disposed to orientationally correspond to the fully closed position of the closure 20 and to provide an abutment blocking each of the locking ribs and resisting attempted reverse, or retrogressive, threaded movement necessary for removal of the closure. Thus, normal threaded removal of the safety closure, such as might be attempted by an unknowledgeable child, is precluded. However, as will hereinafter be described, removal of the safety closure by a mature or knowledgeable person may be accomplished in a relatively facile manner.

Figure 3:
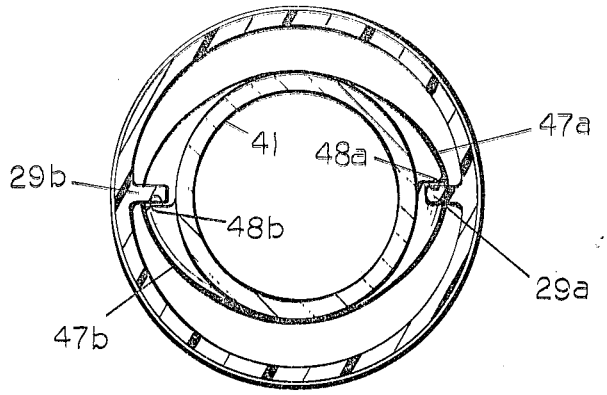
FIG. 3 is a sectional view taken along and in the direction of sectional plane 3—3 in FIG. 2.
Figure 4:
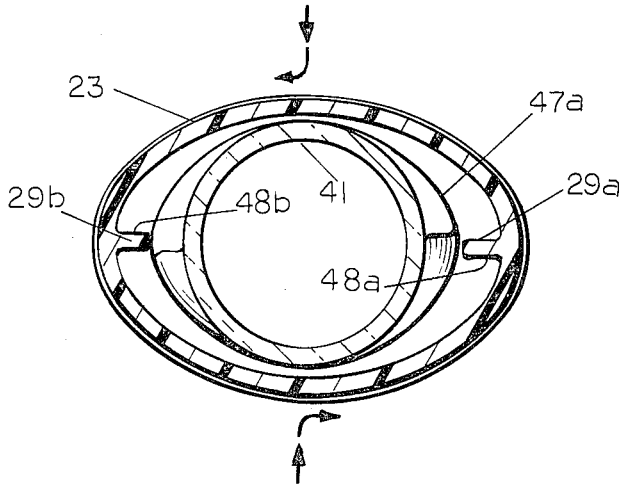
FIG. 4 is a sectional view similar to that depicted in FIG. 3, but depicting certain functional characteristics of the invention by showing the distorted elliptical cross-sectional configuration of the safety closure relative to the dispensing end of the container resulting from manually compressing opposite sides of the safety closure to disengage the closure from interlocking engagement with the container.
Figure 5:
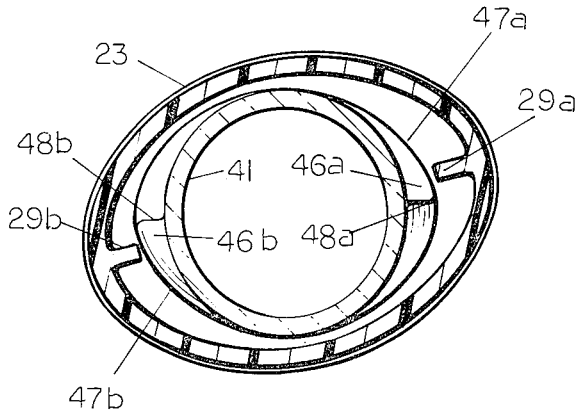
FIG. 5 is another sectional view similar to FIG. 3, but further showing the distorted closure removably, or retrogressively, rotated a fractional revolution subsequent to disengagement of the child-resistant interlock.

As best depicted in FIGS. 3–5, to accomplish threaded removal of the closure 20, the locking ribs 29*a* and 29*b* must first be disengaged from interlocking engagement, or abutment, with the radial ledges 48*a* and 48*b*. Such disengagement from the interlocking engagement depicted in FIG. 3 may be readily accomplished by manually compressing the resiliently deformable, distal end portion 28 of the closure outer sidewall 23 at peripheral locations straddling the locations of interlocking engagement to thereby deform, or distend, the outer sidewall 23 of the closure 20 from its normal generally circular cross-sectional configuration, shown in FIG. 3, to a generally elliptical cross-sectional configuration depicted in FIG. 4. Such manual compression coupled with concurrently applied retrogressive rotation of the closure 20 (indicated by directional arrows in FIG. 4) permits the locking ribs 29*a* and 29*b* to override the radial ledges 48*a* and 48*b*, as depicted in FIG. 5, and allow further retrogressive rotation of the closure.

Figure 6:
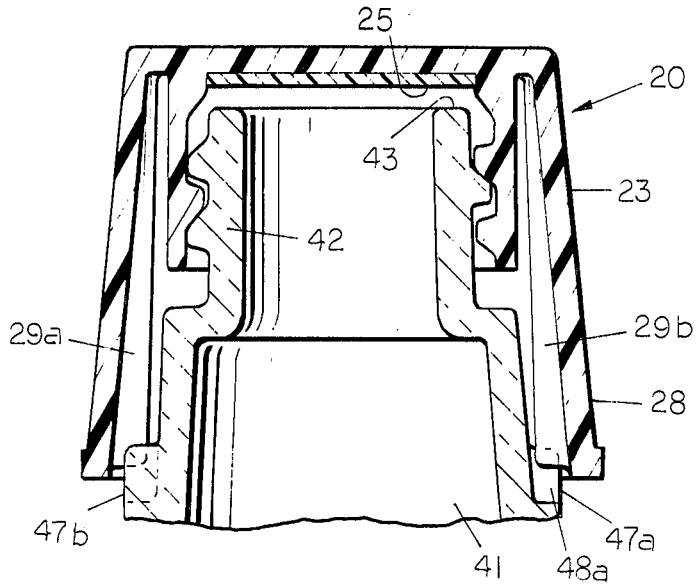
FIG. 6 is a central elevational view of the embodiment depicted in FIG. 2, but, for purposes of showing the multiple interlock aspects of the child-resistant closure with the container, illustrating the interlocking positions of the closure and the container when the closure has been removably, or retrogressively, rotated through 180°, or one-half threaded revolution relative to the container neck.

Preferably, the axial height, or extent, of the camming surfaces 47*a* and 47*b*, and their respective radial ledges 48*a* and 48*b*, is such that they will again, as shown in FIG. 6, intercept the locking ribs 29*a* and 29*b* when the closure 20 has been retrogressively rotated one-half threaded turn, or 180°, from its fully closed position. Upon arrival at the position shown in FIG. 6, the locking ribs 29*a* and 29*b* and the radial ledges 48*a* and 48*b* will again be in position to intercept each other and block further normal threaded removal of the closure 20. Although it is possible to maintain continued manual compression and concurrent retrogressive rotation of the closure sufficiently to rotate the closure in excess of 180° to avoid a secondary interlocking, as shown in FIG. 6, the necessary manual dexterity required is quite difficult even for a person possessing knowledge of the operational characteristics of the interlocking members, and more importantly is beyond the ordinary capabilities of an immature child. Otherwise stated, once the closure 20 has been retrogressively shifted to the position indicated in FIG. 5, manual compression will ordinarily be released in favor of a succession of normal twisting movements; each of which is customarily much less than 180° in extent. Thus, a second interlocking engagement between the closure and container will ordinarily result and will require a repetition of the compressive and turning movements described with respect to FIGS. 3–5. Keeping the foregoing in mind, it is exceedingly unlikely that an immature child would possess the requisite comprehension to premeditatively apply the necessary repetitious manual compression and concurrent retrogressive rotation, particularly at peripheral locations straddling the interlocking locations, necessary to remove the closure from the container. In other words, although an immature child possibly might accidentally disengage the closure from its initial fully closed and interlocked position on the dispensing end of the container, the liklihood of repetition of such accidental disengagement from the next sequential interlocking location, removed 180° from the fully closed position, is extremely remote.

While the foregoing embodiment has been shown and described as having only two sequential interlocking locations corresponding to the fully closed position of the closure 20 on the dispensing end 41 of the container 40 and a position in which the closure has been retrogressively rotated 180°, it will be readily apparent that, if desired, additional sequential interlocking locations may be provided by longitudinally extending the radial ledges 48*a* and 48*b* sufficiently to intercept the locking ribs 29*a* and 29*b* at additional locations during removal of the closure. In any event, repeated and premeditatively applied manual compression of the distal end 28 of the outer sidewall 23 of the closure 20 coupled with retrogressive rotation of the closure will permit the closure to be rotated to a position, such as shown in FIG. 7, whereafter the closure may be threadably removed in conventional, non-compressed, manner.

Several alternative versions, or embodiments, of the present invention will be hereinafter described. However, with respect to each of the various ensuing embodiments, it should be borne in mind that the basic interlocking features of the double sidewalled closure and container are retained, including the provision on the closure of the resiliently deformable, or distensible, outer sidewall which in response to manual compression and retrogressive rotative movements, in the manner indicated in FIGS. 3–5, may be sequentially disengaged from the successive interlocking locations on the dispensing end of the container.

Figure 7:
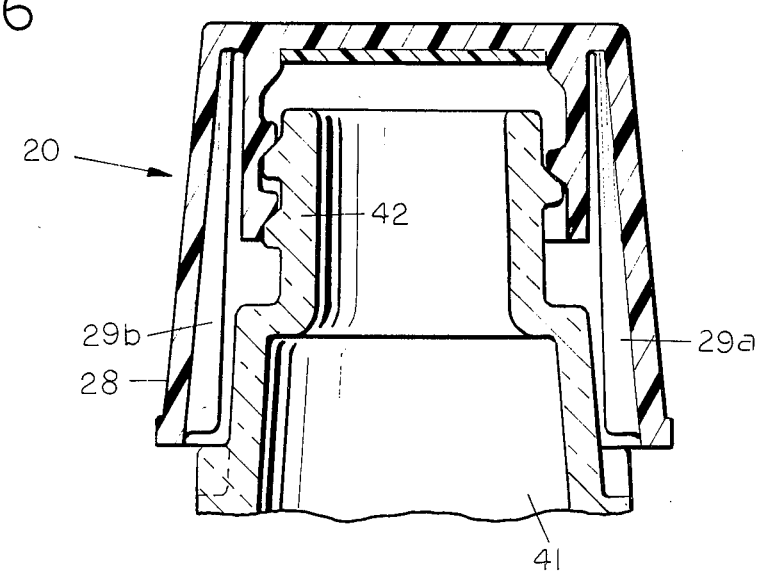
FIG. 7 is a view similar to FIG. 6, but depicting the relative relationship of the interlocking means after the safety closure has been removably rotated 360° relative to the container neck.
Figure 8:
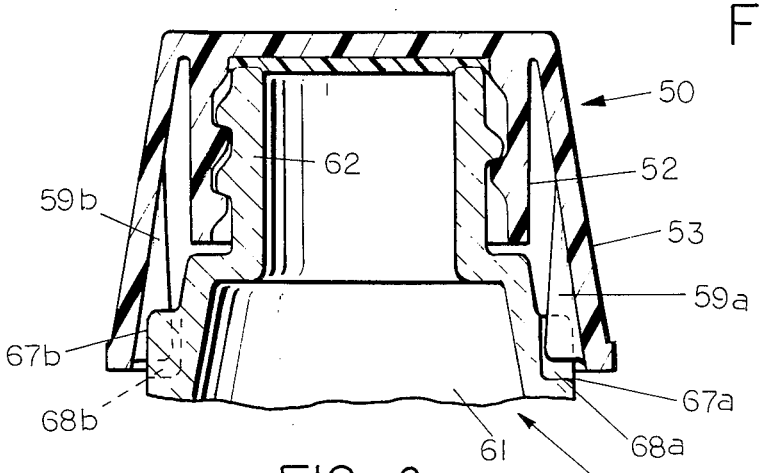
FIG. 8 is a centrally sectioned elevational view depicting an alternative version of the child-resistant closure of the present invention assembled in fully closed and interlocked position on the dispensing end of a container.
Figure 9:
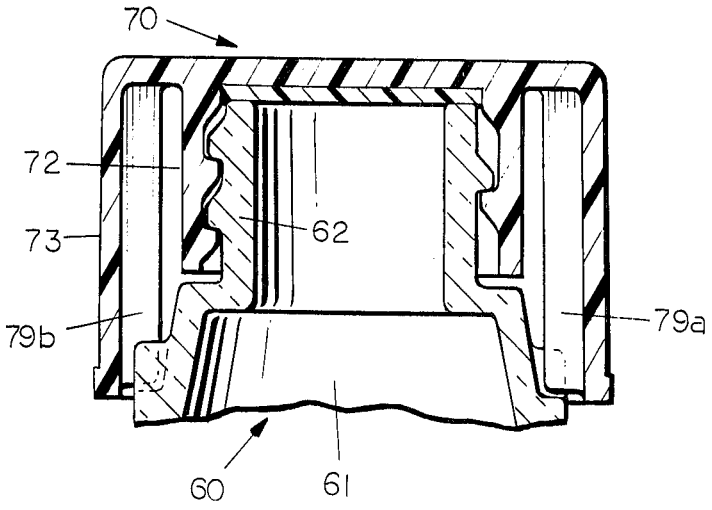
FIG. 9 is also a centrally sectioned elevational view depicting another alternative version of the child-resistant safety closure of the present invention assembled in fully closed and interlocked position on the dispensing end of a container.

As depicted in the two alternative embodiments appearing respectively in FIGS. 8 and 9, placement of the closure interlocking member, or members, on the resiliently distensible outer sidewall of the double sidewalled closure affords substantial advantageous variations in the overall length, style, and configuration of the closure, and accommodates implementation of the concepts of the present invention into numerous child-resistant, safety closure styles and designs. Thus, in the alternative version of the present invention shown in FIG. 8, the double sidewalled closure, designated as 50, which is shown in a fully closed and interlocked engagement with the slightly modified dispensing end of the container 60, includes a frusto-conical outer sidewall 53, which is substantially shorter in overall axial length than the embodiment depicted in FIGS. 1–7. Also, the integral diametrically opposite, tapered locking ribs 59*a* and 59*b* on the interiorly facing surface of the outer sidewall 53, respectively, converge into the outer sidewall at a location intermediate the opposite longitudinal ends thereof. To accommodate the shorter overall length of the outer sidewall 53, the container 60 and its dispensing end 61 are modified in such manner that the diametrically opposite camming surfaces 67*a* and 67*b* are positioned in closer axially spaced proximity to the threaded neck portion 62 of the container and so that the radial ledges 68*a* and 68*b* are properly oriented to interlock with the locking ribs 59*a* and 59*b* when the closure is in its fully closed position.

In the alternative version depicted in FIG. 9, the frusto-conical shaped configuration of the outer sidewall shown in FIGS. 6–8, is replaced by a closure 70 having an outer sidewall 73 defining a longitudinally extending, circular configuration which is disposed in concentric relationship with the inner sidewall 72. Additionally, in this version of the present invention, the diametrically opposite locking ribs 79*a* and 79*b* are arranged to extend parallel to the longitudinal axis of the closure 70.

Various alternative embodiments of the present invention to be hereinafter described feature means for providing the double sidewalled closure with a frictional fluid-tight seal which may serve as a primary seal or as a back-up seal to prevent leakage of the container's contents even though the closure is partially removed from its fully closed position. These further embodiments are also suitable to afford a fluid-tight seal at and between both the fully closed and the succeeding partially removed interlocking locations of the closure on the container.

Figure 10:
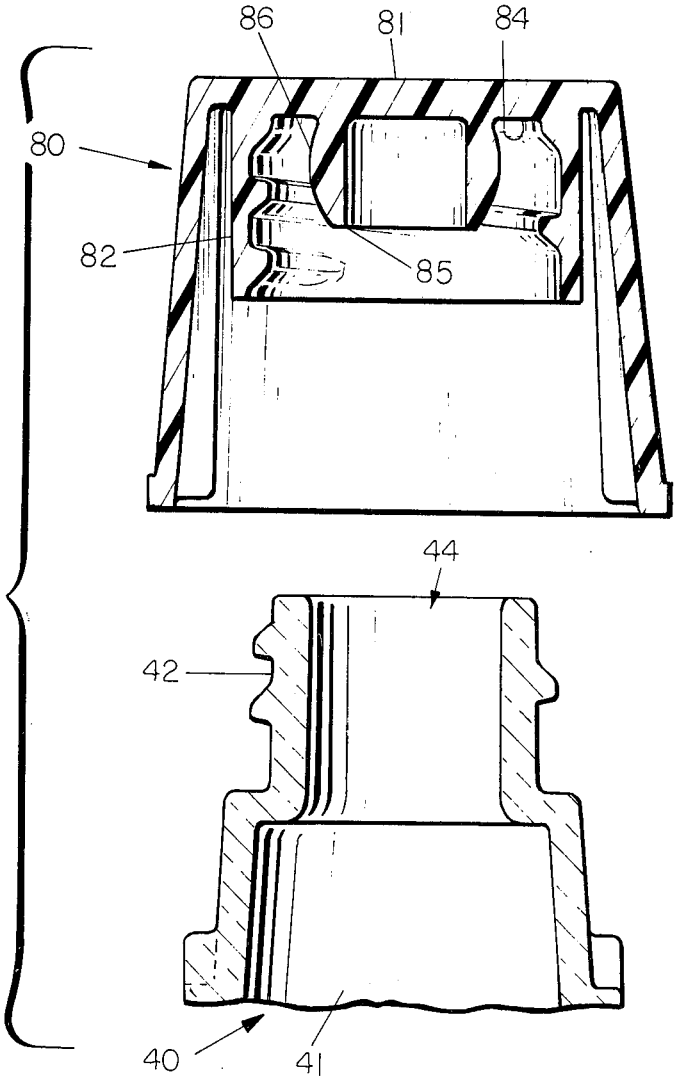
FIG. 10 is an exploded elevational view in central section of another alternative version of the present invention, wherein the safety closure includes a frictionally slidable plug-type sealing member insertable within the dispensing opening in the container neck.
Figure 12:
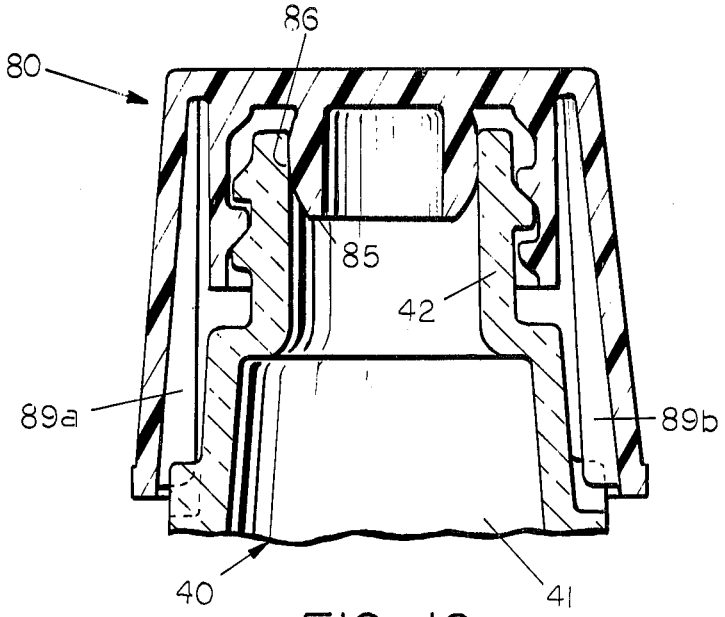
FIG. 12 is another centrally sectioned elevational view of the embodiment shown in FIG. 10, but illustrating the sealing capability of the plug-type closure member when the closure has been removably rotated 180° to a subsequent sequential interlocking position on the dispensing end of the container.
Figure 11:
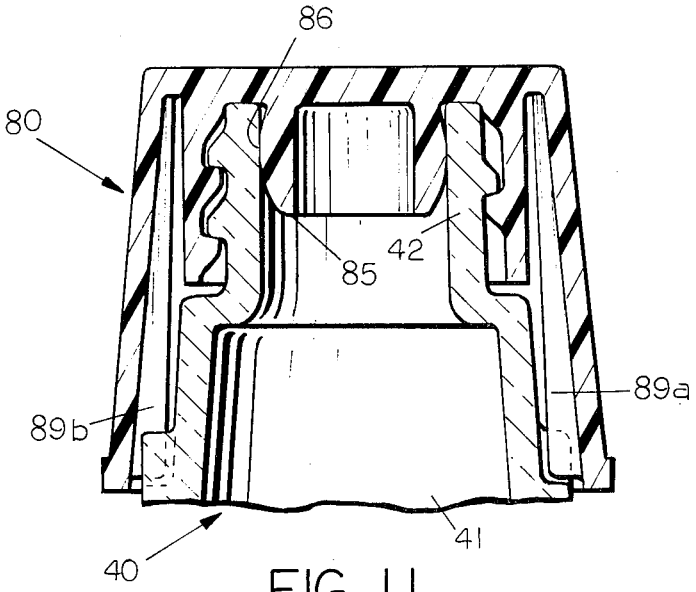
FIG. 11 is a centrally sectioned elevational view of the safety closure and container shown in FIG. 10, but depicting the closure assembled in fully closed and child-resistant, interlocking engagement with the dispensing end of the container.

More particularly, the embodiment of the invention depicted in FIGS. 10–12 features the inclusion of plug-type sealing means which is effective to maintain the child-resistant, safety closure in fluid-tight sealed relationship with the container even though the closure has been threadably rotated a substantial extent relative to the intended fully closed position on the dispensing end of the container. As best shown in FIG. 10, the child-resistant, safety closure 80 is illustratively shown in association with the same form of container 40 depicted in FIGS. 1–7, and features a coaxially aligned sealing plug 85 of resilient material depending integrally from the underside surface 84 of the closed endwall 81 of the closure and arranged in interspaced concentric relationship within the annular, threaded inner sidewall 82. As shown, the sealing plug 85 is preferably provided with an outer peripheral surface portion defining a radially enlarged and convexly rounded, peripheral sealing segment 86 which, as shown in FIGS. 11 and 12, is snugly insertable within the dispensing opening 44 of the container to provide a continuous, peripheral, fluid-tight frictional seal against the interior wall surface of the container neck portion 42. In other respects, the child-resistant, safety closure 80 embodies the double sidewalled and interlocking features previously discussed with respect to the embodiment shown in FIGS. 1–6.

As thus constructed, threaded advancement of the closure 80 to its fully closed and interlocked position (FIG. 11) on the dispensing end 41 of the container 40 forces the sealing plug into the dispensing opening 44 and into snug, fluid-tight, peripherally sealed relationship with the interior surface of the container neck portion 42. As best shown in FIG. 12, the axial extent, or length, of the sealing plug 85 is preferably sufficient to ensure continuous fluid-tight, sealing contact with the interior surface of the container neck portion 42 even when the closure 80 is threadably displaced from the fully closed and interlocked position (FIG. 11) and retrogressively rotated to a succeeding interlocked position, such as, for example, the position illustrated in FIG. 12, wherein the closure 80 has been rotatively removed 180° and the locking ribs 89*a* and 89*b* shifted to a succeeding, back-up interlocking position.

Figure 13:
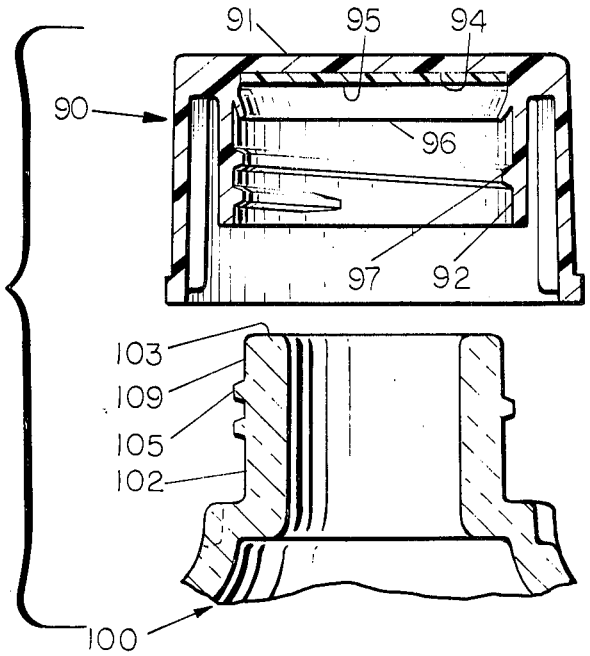
FIG. 13 is an exploded centrally sectioned elevational view of the dispensing end of a container with still another alternative version of the child-resistant safety closure of the present invention in which a frictionally slidable seal is provided between the safety closure and the dispensing end of the container.
Figure 14:
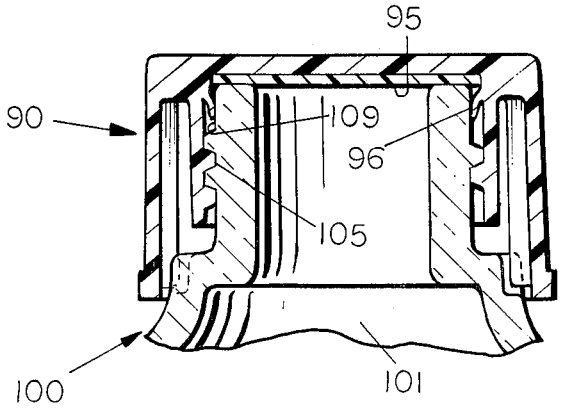
FIG. 14 is a centrally sectioned elevational view of the version of the invention shown in FIG. 13, but illustrating the functional aspects of the frictional seal between the closure and the container neck when the closure is positioned in fully closed and child-resistant, interlocking engagement with the dispensing end of the container.
Figure 15:
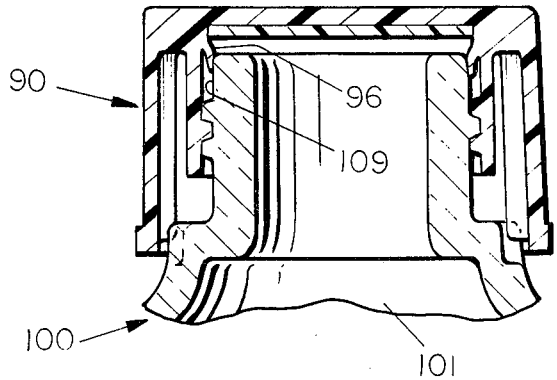
FIG. 15 is a view similar to FIG. 14, but further illustrating the functional aspects of the frictional seal and sequential interlock when the closure has been removably rotated 180° from the fully closed interlocked position depicted in FIG. 14.

Another alternative embodiment of the invention is shown in FIGS. 13–15, wherein a child-resistant, safety closure incorporating the plural interlock and double sidewall features of the present invention further includes another form of frictionally slidable sealing means between the safety closure and the neck portion of the container 100. As illustrated, the container neck portion 102 includes a smooth, axially extended exterior neck finish defining a peripheral secondary sealing surface 109 disposed between the annular rim 103 and the exterior threads 105. As shown, the double sidewalled safety closure 90 includes, as in the embodiments in FIGS. 1–8, a resilient, fluid-impermeable sealing liner 95 provided on the underside surface 94 of the closed endwall 91 and which is arranged to seat upon the annular rim 103 of the container 100 in fluid-tight sealed relationship when the safety closure 90 is in fully closed position. Additionally, however, the closure 90 includes a continuous annular sealing bead 96 of flexible and resilient material formed integrally on the interior surface of the inner sidewall 92 at a location intermediate the threaded interior portion 97 and the sealing liner 95. In the form shown in FIGS. 13–15, the sealing bead 96 slopes convergently inwardly and axially away from the closed endwall 91 of the closure to define an innermost end portion of circular configuration of slightly smaller diameter than the secondary sealing surface 109 on the container neck portion 102. As thus constructed, the innermost end portion of the sealing bead 96 will snugly contact the secondary sealing surface 109 in fluid-tight sealed relationship and thereby provide a secondary seal as a back-up to the sealing liner 95 when the safety closure 90 is assembled, as illustrated in FIG. 14, in fully closed position on the dispensing end 101 of the container 100. Moreover, the secondary sealing surface 109 is of sufficient axial extent to maintain continuous fluid-tight, frictional, sealing contact with the sealing bead 96 when the closure is threadably displaced a substantial distance away from the fully closed position. Preferably, as shown in FIG. 15, the axial extent of the secondary sealing surface 109 is sufficient to maintain continuous sealing contact with the sealing bead 96 throughout threaded retrogressive movement, or removal, of the safety closure 90 to the next succeeding interlocking location with the dispensing end 101 of the container 100; the next succeeding interlocking location being illustrated in FIG. 15 as one-half threaded revolution, or 180°, removed from the fully closed position.

Figure 16:
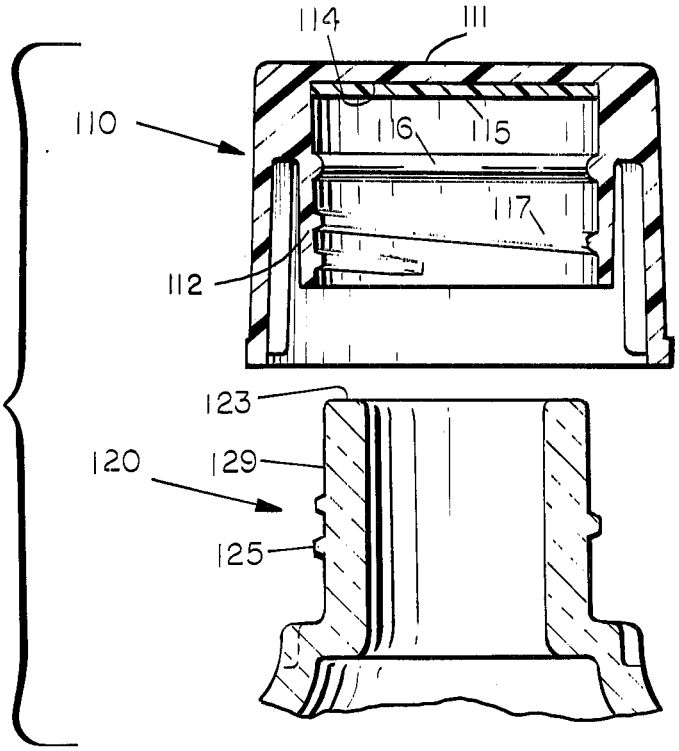
FIG. 16 is an exploded centrally sectioned elevational view of yet another alternative version of the present invention in which a frictional seal is provided between the safety closure and the dispensing end of the container.
Figure 17:
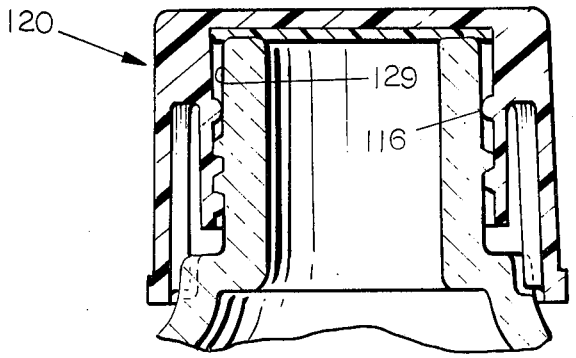
FIG. 17 is also a central sectional view of the safety closure and container combination depicted in FIG. 16, but illustrating the closure asembled in fully closed and child-resistant interlocking engagement with the dispensing end of the container.
Figure 18:
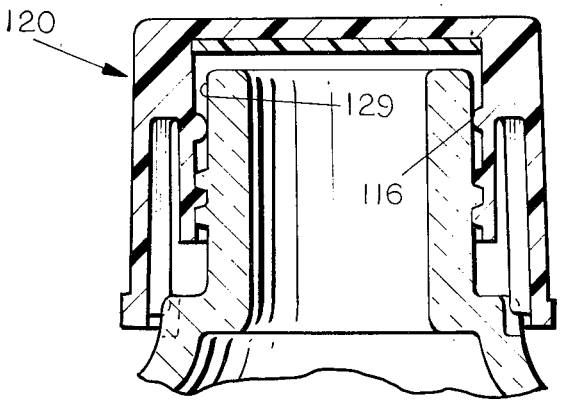
FIG. 18 is a view similar to FIG. 17, but illustrating the sequential interlocking and concurrent retention of the sealed relationship between the safety closure and container when the closure has been rotatably removed 180° relative to the fully closed position thereof on the container neck portion.

By way of contrast with the embodiment of the invention depicted in FIGS. 13–15, another form of peripheral sealing bead 116 of resilient material is illustrated in FIGS. 16–18 as being integrally formed on the interior surface of the inner sidewall 112 of the safety closure 110. As shown, the sealing bead 116, as in the previously described embodiment, is disposed between the inner sidewall threads 117 and the sealing liner 115 on the underside surface 114 of the closed endwall 111 of the closure. Again, as with the previous embodiment, the neck portion 122 of the container 120 is provided with a smooth, axially elongated, exterior finish which defines a secondary sealing surface 129 disposed between the annular sealing rim 123 and the neck threads 125. The sealing surface 129, which is slightly larger in diameter than the interior surface of the sealing bead 116, will thus contact the sealing bead 116 in snug, fluid-tight, frictional sealing contact when the safety closure 110 is threadably advanced to the fully closed position on the dispensing end of the container, as shown in FIG. 17, as well as when the safety closure is threadably rotated to a succeeding interlocking position, as depicted in FIG. 18, in which the safety closure has been removably rotated through 180° or one-half threaded revolution.

Thus, in each of the three separate embodiments depicted in FIGS. 10–12, 13–15 and 16–18, respectively, an axially slidable fluid-tight seal is maintained between the child-resistant, safety closure and the dispensing end of the container even though the safety closure becomes substantially displaced from the fully closed and interlocked position. Also, in each instance, the maintenance of this fluid-tight sealed relationship is effective to preclude leakage of the container's contents from within the protective confines of the safety closure while the safety closure is retained in child-resistant, interlocked engagement with the dispensing end of the container. Consequently, effective assurance is provided that there is little, if any, liklihood of escape of the container's contents or resultant accessibility thereof to a young child.

Although the present invention has been illustrated and described in a preferred embodiment employing a closure having a pair of diametrically opposite locking ribs and a complementary pair of camming surfaces, or radial ledges, it will be readily apparent that one such locking rib together with one or more camming surfaces would also be effective and possibly be desirable in certain instances without detracting from the basic features of the present invention. Moreover, it will be clearly apparent that the interlocking members may be reversed in such manner that the camming surface, or surfaces, with their accompanying radial ledge, or ledges, are provided on the interior surface of the outer sidewall of the closure, and correspondingly the locking rib, or ribs, are provided on the exterior surface of the dispensing end of the container.

It will, of course, be understood that various details of construction, combination and assembly may be modified throughout a range of equivalence, and it is, therefore, not the purpose to limit the scope of the present invention otherwise than as necessitated by the scope of the appended claims.

I claim:

1. A child-resistant safety closure adapted for threadable attachment on a container having a generally cylindrical hollow dispensing end including an exteriorly threaded neck portion, an annular rim defining a dispensing opening, and an interlocking member orientationally arranged to interlock said closure on said dispensing end when said closure is threadably advanced to a fully closed position on said neck portion, said closure comprising:

a closed endwall provided with sealing means on the underside surface thereof arranged to seal said dispensing opening in fluid-tight sealed relationship, a pair of annular inner and outer sidewalls depending integrally from said closed endwall in radially interspaced relationship, said outer sidewall having a distal end portion projecting axially beyond said inner sidewall and defining a generally circular cross-sectional configuration, said distal end portion being sufficiently flexible to deform from said generally circular cross-sectional configuration to a generally elliptical cross-sectional configuration in response to manual compression of diametrically opposite sides thereof and being sufficiently resilient to essentially resume said generally circular cross-sectional configuration promptly upon release of said manual compression, said inner sidewall defining a threaded interior surface portion threadably engageable with the threaded neck portion of said container to accommodate threaded advancement of said closure on said neck portion to said fully closed position in which said sealing means is adapted to assume fluid-tight sealing relationship with said dispensing opening;

an interlocking member integrally formed on the outer sidewall of said closure and adapted to override interlocking engagement with the interlocking member on said container in response to normal threaded advancement of said closure on said neck portion, but to intercept the latter interlocking member in interlocking engagement in response to normal threaded retrogressive movement of said closure on said neck portion, and said interlocking engagement being releasable in response to manual compression and concurrent threaded retrogressive movement applied to said outer sidewall of said closure; and said interlocking member on said closure being arranged to interlock with said interlocking member on said container at sequential interlocking locations orientationally related respectively to at least two separate threadably engaged positions of said closure on said neck portion, one of said interlocking locations being arranged to correspond to said fully closed position of said closure and another of said interlocking locations being disposed to substantially precede arrival of said closure in said fully closed position, whereby manual compression coupled with concurrent threaded retrogressive movement customarily must be repetitiously and premeditatively applied to said outer sidewall of said closure at peripheral locations straddling the interlocking locations in order to threadably remove said closure from said neck portion.

2. In a child-resistant safety closure as defined in claim 1, wherein said interlocking members respectively comprise at least one locking rib and at least one inclined camming surface, said camming surface being inclined in the direction of the path of threaded advancement of said closure and adapted to intercept said locking rib and resiliently distend said outer sidewall sufficiently to accommodate normal threaded advancement of said closure past said camming surface to said fully closed position, said camming surface abruptly terminating in a radial ledge disposed to intercept said locking rib and block normal retrogressive movement of said closure when said closure is at either of said sequential interlocking locations, thereby requiring manual compression of said outer sidewall and concurrent threaded retrogressive movement of said closure to permit said locking rib to retrogressively override said ledge at either of said sequential interlocking locations.

3. In a child-resistant safety closure as defined in claim 2, wherein said locking rib is shaped in the form of an axially elongated rib defining a relatively narrow inwardly facing surface and having one longitudinal end thereof terminating at a location proximately recessed within the confines of the distal end of said outer sidewall.

4. In a child-resistant safety closure as defined in claim 3, wherein said locking rib has an opposite longitudinal end adjoining the underside surface of said closed endwall.

5. In a child-resistant safety closure as defined in claim 1, wherein the outer sidewall of said closure defines a frusto-conical configuration.

6. In a child-resistant safety closure as defined in claim 3, wherein said locking rib has an opposite axial end portion merging with a medial region of the interior surface of said outer sidewall.

7. In a child-resistant safety closure as defined in claim 6, wherein the outer sidewall of said closure defines a frusto-conical configuration.

8. In a child-resistant safety closure as defined in claim 2, wherein said locking rib is integrally formed on the interiorly facing surface of the outer sidewall of said closure and said camming surface is integrally formed on the exteriorly facing surface of the dispensing end of said container.

9. In a child-resistant safety closure as defined in claim 1, wherein said interlocking members respectively comprise a pair of diametrically opposed locking ribs and a pair of diametrically opposed camming surfaces each having a radial ledge, and wherein each one of said pair of locking ribs is adapted to sequentially engage each one of said radial ledges in interlocking engagement during threaded retrogressive movement of said closure on said neck portion.

10. In a child-resistant safety closure as defined in claim 1, wherein the sealing means on said closure comprises a resilient fluid-impermeable liner arranged to seat against the annular rim on said container neck portion in fluid-tight sealing relationship when said closure is in said fully closed position.

11. In a child-resistant safety closure as defined in claim 1, wherein the sealing means on said closure comprises an axially depending central plug disposed concentrically within said inner sidewall, said plug having an outer peripheral surface portion snugly insertable within said dispensing opening and providing continuous peripheral fluid-tight sealing contact with the interior wall surface of said neck portion when said closure is in said fully closed position.

12. In a child-resistant safety closure as defined in claim 11, wherein said plug is of sufficient axial extent to maintain said fluid-tight sealing contact with the interior sidewall surface of said neck portion in each of said interlocking locations of said closure and said neck portion.

13. In a child-resistant safety closure as defined in claim 1, wherein the inner sidewall of said closure includes an annular inwardly projecting sealing bead disposed to seat against the container neck portion in continuous peripheral sealing contact and form a fluid-tight seal therewith when said closure is in said fully closed position.

14. In a child-resistant safety closure as defined in claim 13, wherein said sealing bead is formed of flexible and resilient material.

15. In a child-resistant safety closure as defined in claim 14, wherein said sealing bead is disposed between said closed endwall and the threaded interior surface portion of said inner sidewall.

16. In a child-resistant safety closure as defined in claim 15, wherein said sealing bead is adapted to be flexed radially outwardly when in sealing contact with said neck portion.

17. In a child-resistant safety closure and container combination comprising:

a container having a generally cylindrical hollow dispensing end including an exteriorly threaded neck portion and an annular rim defining a dispensing opening;

a closure for said container having a closed endwall provided with sealing means on the underside surface thereof arranged to seal said dispensing opening in fluid-tight sealed relationship, and an integral pair of annular depending inner and outer sidewalls arranged in radially interspaced relationship, said outer sidewall having a distal end portion projecting axially beyond said inner sidewall and defining a generally cylindrical cross-sectional configuration, said distal end portion being sufficiently flexible to deform from a generally circular cross-sectional configuration to a generally elliptical cross-sectional configuration in response to manual compression of diametrically opposite sides thereof and being sufficiently resilient to essentially resume said generally cylindrical cross-sectional configuration promptly upon release of said manual compression, said inner sidewall defining a threaded interior surface portion threadably engageable with the threaded neck portion of said container to accommodate threaded advancement of said closure on said neck portion to a fully closed position in which said sealing means is adapted to assume fluid-tight sealing relationship with said dispensing opening;

cooperative interlocking means including interlocking members integrally formed on the outer sidewall of said closure and on the dispensing end of said container, said interlocking members being arranged to override interlocking engagement with each other in response to normal threaded advancement of said closure on said neck portion and to intercept each other in interlocking engagement in response to normal threaded retrogressive movement of said closure on said neck portion, and said interlocking engagement being releasable in response to manual compression and concurrent threaded retrogressive movement applied to said outer sidewall of said closure at peripheral locations straddling said interlocking engagement; the improvement wherein said interlocking members are arranged to interlock in sequential interlocking locations orientationally related respectively to at least two separate threadably engaged positions of said closure on said neck portion, one of said interlocking locations being arranged to correspond to said fully closed position of said closure and another of said interlocking locations being disposed to substantially precede arrival of said closure in said fully closed position, whereby manual compression coupled with concurrent threaded retrogressive movement customarily must be repetitiously and premeditatively applied to said outer sidewall of said closure at peripheral locations straddling said interlocking locations in order to threadably remove said closure from said neck portion.

18. In a child-resistant safety closure and container combination as defined in claim 17, wherein said interlocking members comprise at least one locking rib and at least one inclined camming surface, said camming surface being inclined in the direction of the path of threaded advancement of said closure and adapted to intercept said locking rib and distend said resilient outer sidewall sufficiently to accommodate normal threaded advancement of said closure past said camming surface to said fully closed position, said camming surface abruptly terminating in a radial ledge disposed to intercept said locking rib and block normal retrogressive movement of said closure when said closure is at either of said sequential interlocking locations, thereby requiring manual compression of said outer sidewall and concurrent threaded retrogressive movement of said closure to permit said locking rib to retrogressively override said ledge at either of said sequential interlocking locations.

19. In a child-resistant safety closure and container combination as defined in claim 18, wherein said locking rib is integrally formed on the interiorly facing surface of the outer sidewall of said closure and said camming surface is integrally formed on the exteriorly facing surface of the dispensing end of said container.

20. In a child-resistant safety closure and container combination as defined in claim 18, wherein said interlocking members comprise a pair of diametrically opposed locking ribs and a pair of diametrically opposed camming surfaces each having a radial ledge, and wherein each one of said pair of locking ribs is adapted to sequentially engage each one of said radial ledges in interlocking engagement during threaded retrogressive movement of said closure on said neck portion.

21. In a child-resistant safety closure and container combination as defined in claim 17, wherein the sealing means on said closure comprises an axially depending central plug disposed concentrically within said inner sidewall, said plug having an outer peripheral surface portion snugly insertable within said dispensing opening and providing continuous peripheral fluid-tight sealing contact with the interior wall surface of said neck portion when said closure is in said fully closed position.

22. In a child-resistant safety closure and container combination as defined in claim 21, wherein said plug is of sufficient axial extent to maintain said fluid-tight sealing contact with the interior wall surface of said neck portion in each of said interlocking locations of said closure and said neck portion.

23. In a child-resistant safety closure and container combination as defined in claim 17, wherein the neck portion of said container includes an exterior peripheral secondary sealing surface disposed between said annular rim and said threaded neck portion, and wherein the inner sidewall of said closure includes an annular inwardly projecting sealing bead of flexible and resilient material disposed to seat against said secondary sealing surface in continuous peripheral sealing contact with said closure is in said fully closed position.

24. In a child-resistant safety closure and container combination as defined in claim 23, wherein the sealing means on said closure comprises a resilient fluid-impermeable liner arranged to seat against the annular rim on said container neck portion in fluid-tight sealing relationship when said closure is in said fully closed position.

25. In a child-resistant safety closure and container combination as defined in claim 23, wherein said secondary sealing surface is of sufficient axial extent to maintain continuous fluid-tight, frictional, sealing contact with said sealing bead when said closure is threadably displaced a substantial distance from the interlocking location corresponding to said fully closed position.

26. In a child-resistant safety closure and container combination as defined in claim 23, wherein said secondary sealing surface is of sufficient axial extent to maintain continuous sealing contact with said sealing bead throughout threaded retrogressive meovement of said closure between the interlocking location corresponding to said fully closed position and the next sequential interlocking location.

27. In a child-resistant safety closure and container combination as defined in claim 17, wherein the last-mentioned interlocking location is disposed about one-half threaded revolution preceding arrival of said closure in said fully closed position.

* * * * *